US009366028B1

(12) United States Patent
Nickerson et al.

(10) Patent No.: US 9,366,028 B1
(45) Date of Patent: Jun. 14, 2016

(54) MASONRY UNIT

(71) Applicant: Concrete Block Insulating Systems, Inc., West Brookfield, MA (US)

(72) Inventors: David L. Nickerson, Wilbraham, MA (US); Paul W. Grycel, Sarasota, FL (US)

( * ) Notice: Subject to any disclaimer, the term of this patent is extended or adjusted under 35 U.S.C. 154(b) by 0 days.

(21) Appl. No.: 14/546,166

(22) Filed: Nov. 18, 2014

Related U.S. Application Data

(60) Provisional application No. 61/905,345, filed on Nov. 18, 2013.

(51) Int. Cl.

| | |
|---|---|
| ***E04C 1/41*** | (2006.01) |
| ***E04B 1/76*** | (2006.01) |
| ***E04B 1/80*** | (2006.01) |
| ***E04C 1/39*** | (2006.01) |
| *E04B 1/74* | (2006.01) |

(52) U.S. Cl.
CPC ... *E04C 1/41* (2013.01); *E04B 1/76* (2013.01); *E04B 1/80* (2013.01); *E04C 1/39* (2013.01); *E04B 2001/741* (2013.01)

(58) Field of Classification Search
CPC ..... E04C 1/39; E04C 1/41; E04B 1/76; E04B 1/80; E04B 2001/741
See application file for complete search history.

(56) References Cited

U.S. PATENT DOCUMENTS

| | | | | | |
|---|---|---|---|---|---|
| 2,490,494 | A | * | 12/1949 | Widman | F25D 25/00 312/301 |
| 3,204,381 | A | * | 9/1965 | Perreton | E04B 2/46 52/309.12 |
| 4,856,249 | A | * | 8/1989 | Nickerson | E04C 1/41 52/309.13 |

* cited by examiner

*Primary Examiner* — Jeanette E Chapman
(74) *Attorney, Agent, or Firm* — Doherty, Wallace, Pillsbury & Murphy, P.C.

(57) ABSTRACT

A masonry unit comprising a block, a first insulation member, and a second insulation member. The block comprises a web transversely formed and connected to an anterior face shell and a posterior face shell. The web has formed on each of oppositely situated abutment side walls thereof a groove. The first insulation member comprises a pair of thumb grips formed on a forward wall thereof, and a pair of plugs formed on an oppositely situated rearward wall thereof. A channel extends from each of the thumb grips to a terminal end of the forward wall. The second insulation member comprises a rearward wall comprising a pair of grooves formed therein, wherein each groove formed in the rearward wall receives one of the plugs. The second insulation member further comprises a pair of flanges, wherein one of the flanges is received within one of the grooves formed on the web.

12 Claims, 20 Drawing Sheets

MASONRY UNIT

BACKGROUND TO THE INVENTION

1. Field of the Invention

The present disclosure relates to masonry, and more particularly to insulating building blocks used in the masonry field.

2. Background of the Invention

The present invention is aimed at improving upon the insulated building block disclosed in U.S. Pat. No. 4,856,249 to Nickerson ("'249"). '249 discloses a two web concrete block having an insulation insert placed within the core of the block to provide thermal insulation over the face of the block except where the cross-ties or webs are located. The insulation insert disclosed in '249 comprises two parts held together by plugs on one part and corresponding holes on the other part. Such a design allows the plug-bearing part to be pushed down against the hole-bearing part thereby causing the plugs to shear off and allowing the former plug-bearing part to slide down to ship lap an insulating insert located in a block located directly below.

The insulated building block disclosed in '249 has several design flaws. For example, the plug and hole design of the insulation insert prevents reuse of the insulation insert once the plugs are shorn off. That is, once the plugs are shorn off, the insulation insert is effectively a two-piece structure which is difficult to work with if there becomes a need to reinstall the insulation insert in a block while a wall is being constructed.

Additionally, the design of the block in '249 has the length of the block extended to protect the vertical edges of the insulation insert that were extended to interlock with the adjacent insulation insert. During packaging of the masonry units in large cubes of blocks, the extended pieces of the block are easily damaged, thereby causing the blocks to be rejected. Additionally, the insulation insert extends above the block at a top side thereof which causes the insulation insert to become crushed or broken.

Also, when water is forced against the face of a masonry wall built from masonry units disclosed in '249, the water can migrate through the outside face shell of the block. Once the water reaches the insulation insert, there is no direct path for the water to run out of the face shell, and the water, therefore, continues to build up in the block's face shell. This water build-up causes damage and negatively affects the physical appearance of the wall.

The physical design of the insulation insert disclosed in '249, in addition to the thickness of the face shell of the block, makes the masonry unit difficult to handle. Typically, a mason picks up a block by grabbing the web or face shell of the block. However, the location of the insulation insert relative to the block, as disclosed in '249, prevents the mason from extending his grip wide enough to safely handle the block.

Also, steel reinforced block walls oftentimes have vertical reinforcing rods or rebars placed in the core of the blocks. These rebars become part of the wall when concrete grout is poured around the rebars to bond them to the wall in a specific location. However, the height of the web of the block makes it difficult to control the flow of the grout. Currently, there is to no method of preventing the grout from flowing over the top of the web into a core that is not to be grouted.

SUMMARY OF THE INVENTION

The above mentioned disadvantages and draw-backs of the prior art are alleviated or greatly overcome by a masonry unit comprising a block and an insulation insert. The block comprises a web transversely formed and centrally connected to an anterior face shell and a posterior face shell. The anterior face shell comprises a top side which slopes downwardly towards and is contiguously formed with an exterior directed side of the anterior face shell such that the exterior directed side has a lower height compared to an oppositely situated interior directed side of the anterior face shell. The web has formed on each of oppositely situated abutment side walls thereof a vertically extending groove.

The insulation insert comprises a first insulation member and a second insulation member. The first insulation member comprises a forward wall oppositely situated to a rearward wall, a proximal lateral wall oppositely situated to a distal lateral wall, and a top side oppositely situated to a bottom side. The top side comprises a substantially planar portion contiguously formed with the rearward wall, and a sloped portion that slopes downwardly towards and is contiguously formed with the forward wall. The substantially planar portion of the top side comprises a recessed portion centrally formed therein. An opening, which is aligned with the recessed portion of the top side, is centrally formed through the forward wall and the rearward wall and extends from the bottom side towards the top side where it terminates at an abutment wall. A pair of thumb grips is formed on the forward wall, while a pair of engagement members, such as, e.g., plugs, wherein the pair of engagement members is formed on the rearward wall. Each of the thumb grips has a weep hole formed therein. A respective channel extends from the weep holes formed in the thumb grips to a terminal end of the forward wall of the first insulation member.

The second insulation member comprises a rearward wall oppositely situated to a forward wall, a top wall oppositely situated to a bottom wall, and a proximal lateral wall oppositely situated to a distal lateral wall. An opening is centrally formed through the forward wall and the rearward wall and extends from the bottom wall towards the top wall where it terminates at an underside of an abutment portion. The rearward wall comprises a pair of engagement members, such as, e.g., substantially vertically extending grooves formed therein, wherein engagement members are separated from one another by the opening of the second insulation member. In an exemplary embodiment, the pair of engagement members comprises a pair of grooves, wherein each of the grooves is formed in the rearward wall, extends to the bottom wall, and is further formed therein.

The second insulation member may further comprise a pair of flanges. Each of the flanges, which are oppositely situated from one another, may extend from the forward wall and towards and into the opening. The second insulation member may further comprise a pair of plates, wherein each plate may be positioned on opposite sides of the opening of the second insulation member and which may perpendicularly extend from the top wall and from the rearward wall of the second insulation member.

The masonry unit may be composed by engaging the engaging members on the rearward wall of the first insulation member with the engaging members on the rearward wall of the second insulation member such that the openings of the two members are aligned, and such that the top wall of the second insulation member is directed towards the top side of the first insulation member.

The resulting insulation insert may then be positioned on the block so that the flanges of the second insulation member are engaged with the grooves formed on the web of the block, the respective undersides of the abutment wall and the abutment portion of the insulation insert abut a top wall of the web, and the lateral sides of the insulation insert extend past the lateral side of the anterior face shell of the block. When used, the plates of the second insulation member flank the top side of the web.

These and various other advantages and features of novelty which characterize the invention are pointed out with particularity in the claims annexed hereto and forming a part hereof. However, for a better understanding of the invention, its advantages, and objects obtained by its use, reference should be had to the accompanying drawings and descriptive matter, in which there is illustrated and described preferred embodiments of the invention.

BRIEF DESCRIPTION OF THE DRAWINGS

For a better understanding of these and other objects of the present invention, reference will be made to the detailed description of the present invention which is to be read in association with the accompanying drawings, wherein.

DETAILED DESCRIPTION OF THE INVENTION

Figure 1:
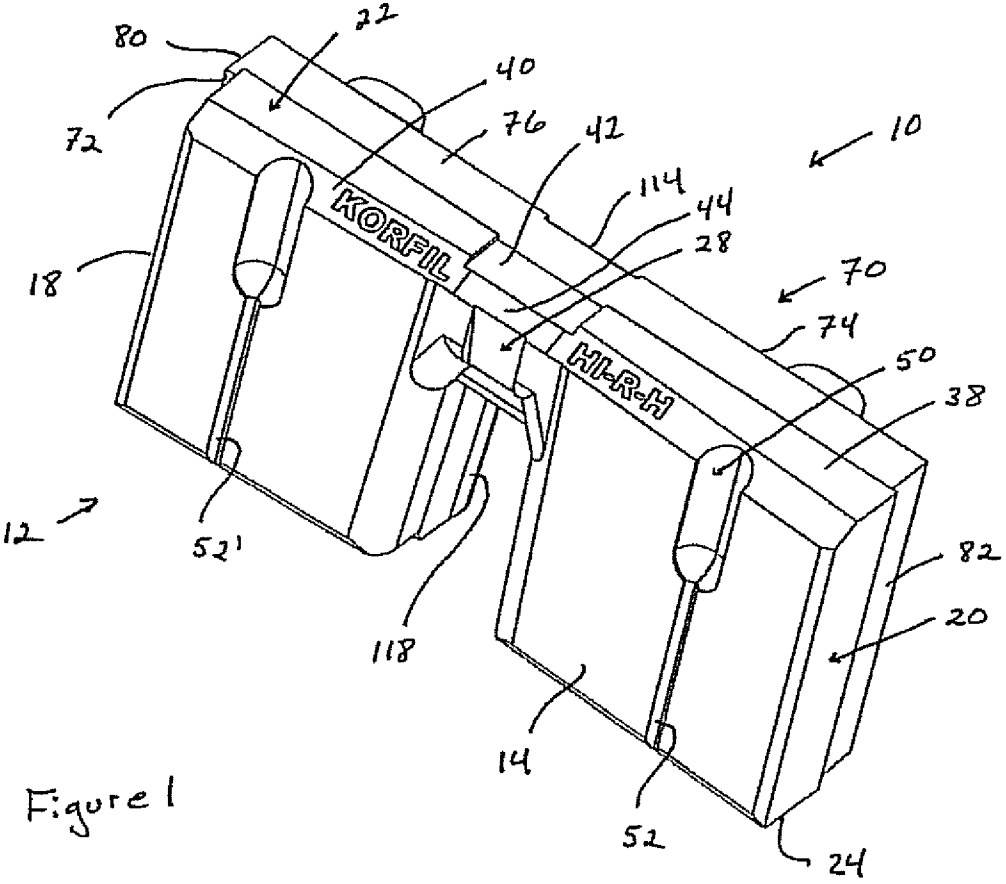
FIGS. 1-3 are schematics depicting an exemplary insulation insert.
Figure 2:
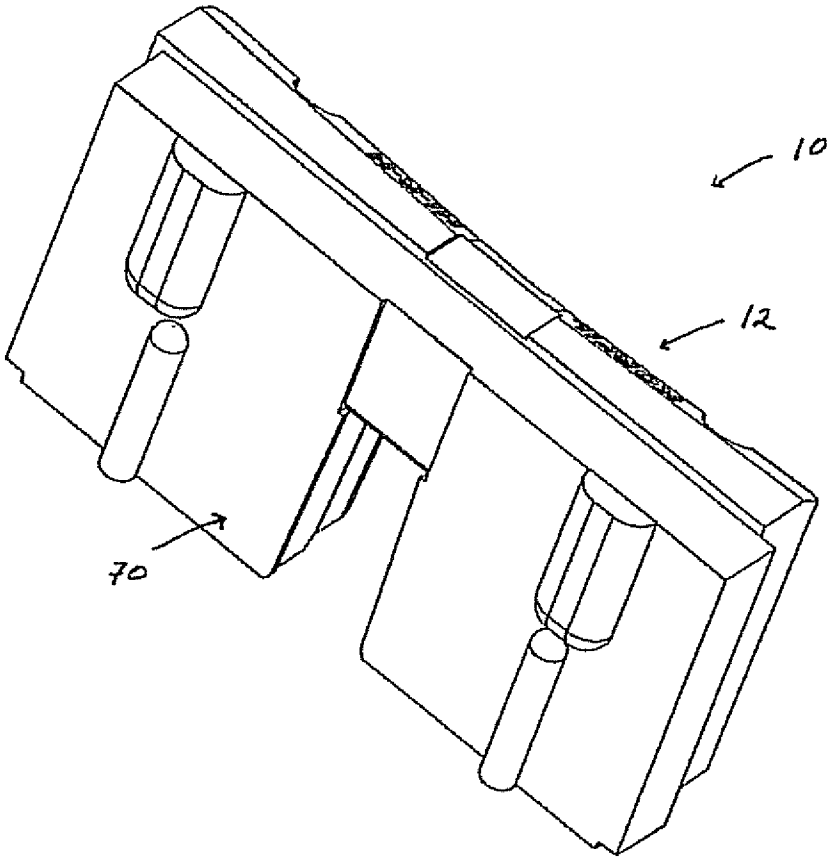
Figure 3:
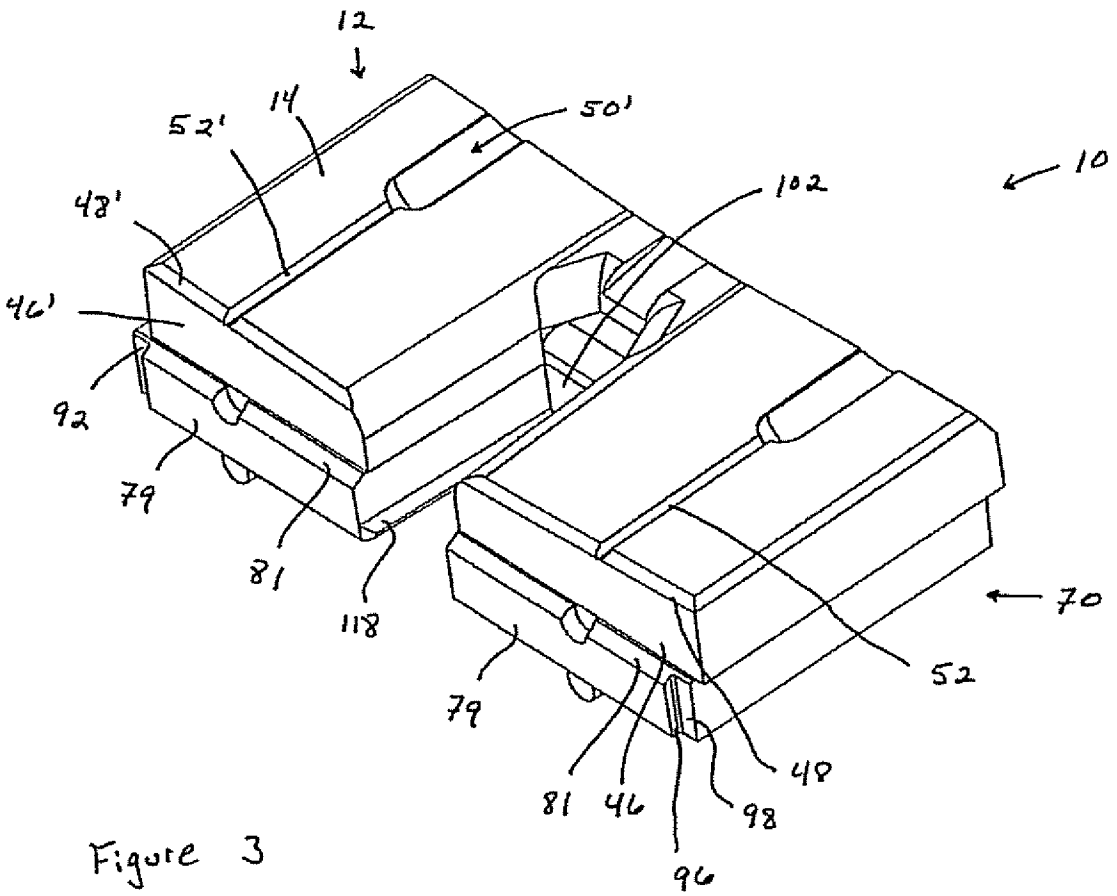
Figure 4:
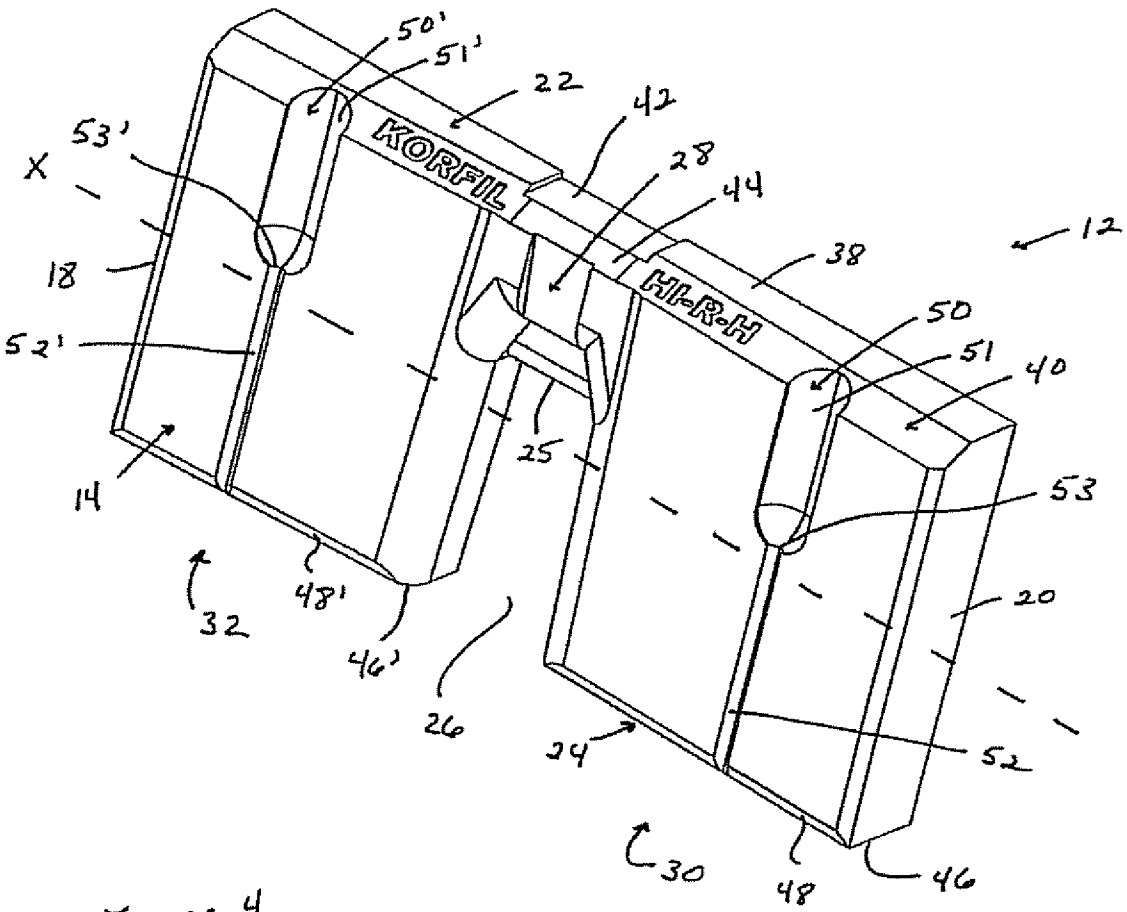
FIG. 4 is a schematic depicting an elevational view of a forward wall of an exemplary first insulation member of the insulation insert depicted in FIGS. 1-3.

Referring to FIGS. 1-3, an exemplary insulation insert 10 comprises a first insulation member 12 and a second insulation member 70. Referring to FIGS. 1-5, first insulation member 12 comprises a forward wall 14 oppositely situated to a rearward wall 16, a lateral wall 18 oppositely situated to a lateral wall 20, and a top side 22 oppositely situated to a bottom side 24. An opening 26 is centrally formed through forward wall 14 and rearward wall 16. Opening 26 extends from an underside 25 of an abutment wall 28 to bottom side 24 to create a substantially U-shaped structure through first insulation member 12. Opening 26 essentially divides insulation insert 10 into a portion 30 and a portion 32.

Top side 22 comprises a horizontally extending planar portion 38 and a horizontally extending sloped portion 40, wherein each of portions 38 and 40 are coterminously formed with lateral walls 18 and 20. Horizontally extending planar portion 38 is coterminously formed with horizontally extending sloped portion 40 on one side thereof and is further coterminous with rearward wall 16 on an opposite side thereof. Horizontally extending sloped portion 40 slopes downwardly from horizontally planar portion 38 towards bottom side 24 and is coterminous on an opposite side thereof with forward wall 14.

A recessed notch 42 is centrally and continuously formed through horizontally extending planar portion 38 of top side 22 and a segment of horizontally extending sloped portion 40 of top side 22, such that recessed notch 42 is approximately aligned with opening 26 and approximately extends a horizontal length of opening 26. A recessed notch 44 is formed through sloped portion 40 and extends from recessed notch 42 towards underside 25 of abutment wall 28, wherein recessed notch 42 is centrally aligned with recessed notch 44, and further wherein recessed notch 42 comprises a horizontal length greater than that of recessed notch 44 such that recessed notch 44 is flanked on both sides thereof by recessed notch 42.

Bottom side 24 comprises a horizontally extending planar portion 46 and a horizontally extending planar portion 46', wherein portions 46 and 46' are separated from one another by opening 26. Horizontally extending planar portion 46 is coterminous with rearward wall 16 and lateral wall 20; while horizontally extending planar portion 46' is coterminous with rearward wall 16 and lateral wall 18.

Bottom side 24 further comprises a sloped portion 48 and a sloped portion 48' contiguously formed with forward wall 14, wherein sloped portion 48 is separated from sloped portion 48' by opening 26. Sloped portion 48 is coterminous with planar portion 46, forward wall 14, and lateral wall 20; while sloped portion 48' is coterminous with planar portion 46', forward wall 14, and lateral wall 18. Each of sloped portions 48 and 48' slopes downwardly from forward wall 14 towards respective planar portions 46 and 46'.

First insulation member 12 further comprises a thumb grip 50 and a thumb grip 50' to respectively formed on portion 30 and portion 32. Thumb grips 50 and 50' are dimensioned and configured to allow a user to insert a portion of the user's thumb into respective grips 50 and/or 50' to thereby assist in the mobilization of insulation insert 10 and/or the masonry unit. To that end, in an exemplary embodiment, each of thumb grips 50 and 50' comprises a respective arcuate-shaped groove 51 and 51' which is formed on horizontally extending sloped portion 40 of top side 22 and on forward wall 14, and which extends from portion 40 to above a horizontal midsection X of forward wall 14. Weep holes 53 and 53' are respectively formed at a base of grooves 51 and 51'. Vertically extending, arcuate-shaped channels 52 and 52' are formed within forward wall 14 and extend from respective weep holes 53 and 53' to respective sloped portions 48 and 48'. Channels 52 and 52' provide an outlet for fluid, such as, e.g., water, which has entered thumb grips 50 and 50', thereby, preventing the undesirable accumulation of water which would otherwise damage insulation insert 10 and/or the masonry unit.

Figure 5:
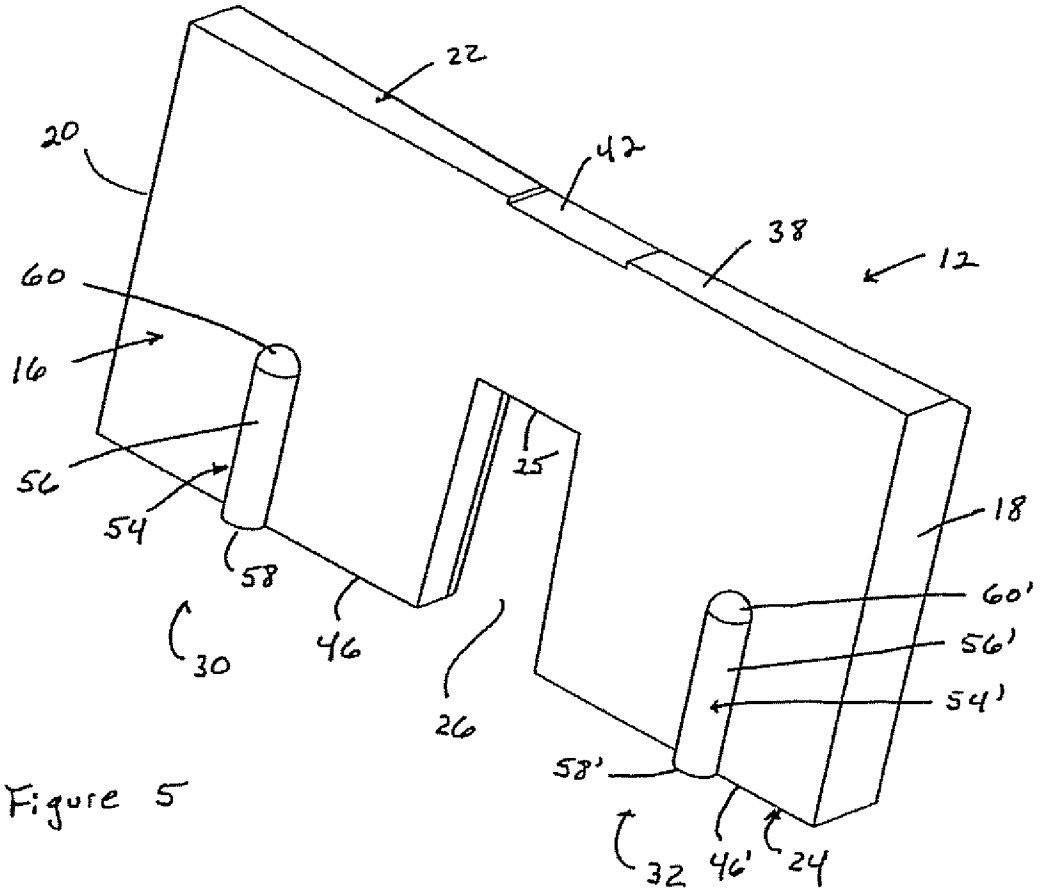
FIG. 5 is a schematic depicting an elevational view of a rearward wall of the first insulation member depicted in FIG. 4.

Referring to FIG. 5, rearward wall 16 of first insulation member 12 comprises an essentially planar surface. A plug 54 and a plug 54' are respectively formed on rearward wall 16 of portion 30 and on rearward wall 16 of portion 32. Each of plugs 54 and 54' has a respective substantially rounded body 56 and 56' which terminates at a respective base 58 and 58' and at an oppositely situated respective cap 60 and 60'. Caps 60 and 60' of respective plugs 54 and 54' are situated approximately below horizontal midsection X of rearward wall 16, and bases 58 and 58' are level with horizontally extending planar portions 46 and 46'.

Figure 6:
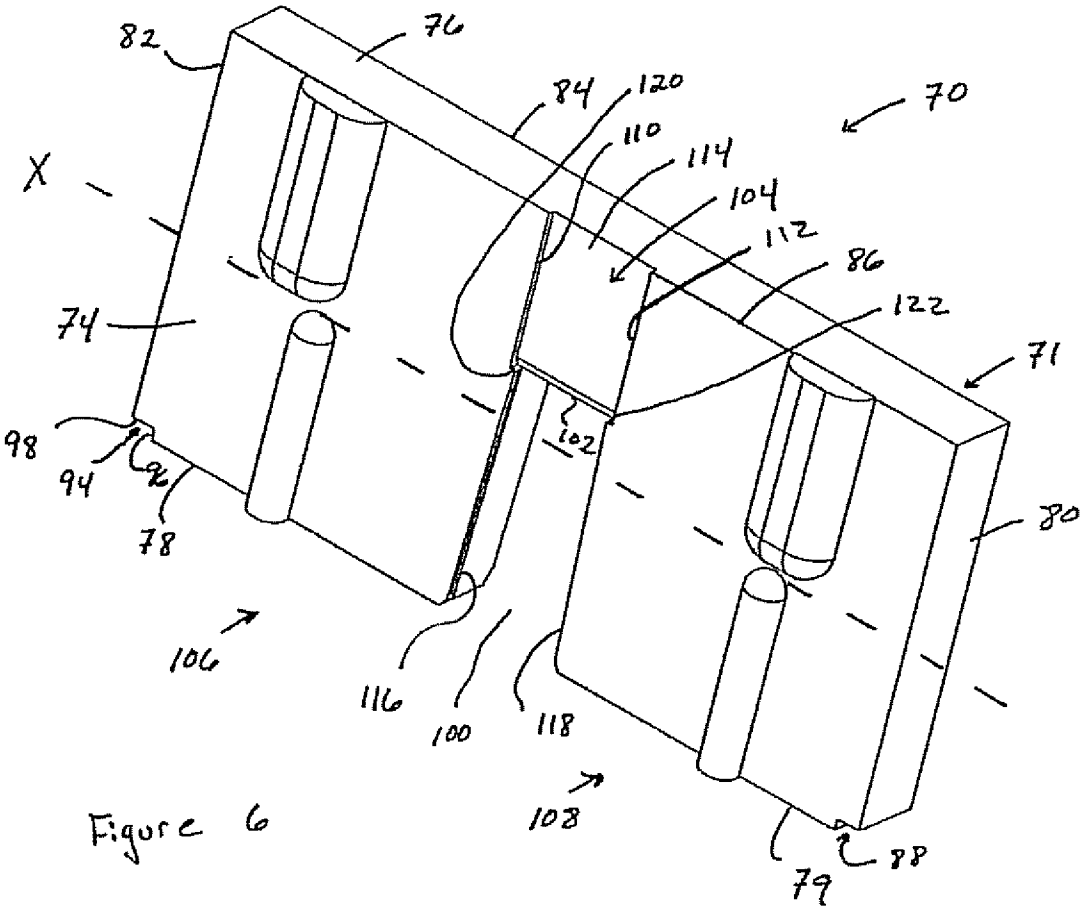
FIG. 6 is a schematic depicting an elevational view of a rearward wall of an exemplary second insulation member of the insulation insert depicted in FIGS. 1-3.
Figure 7:
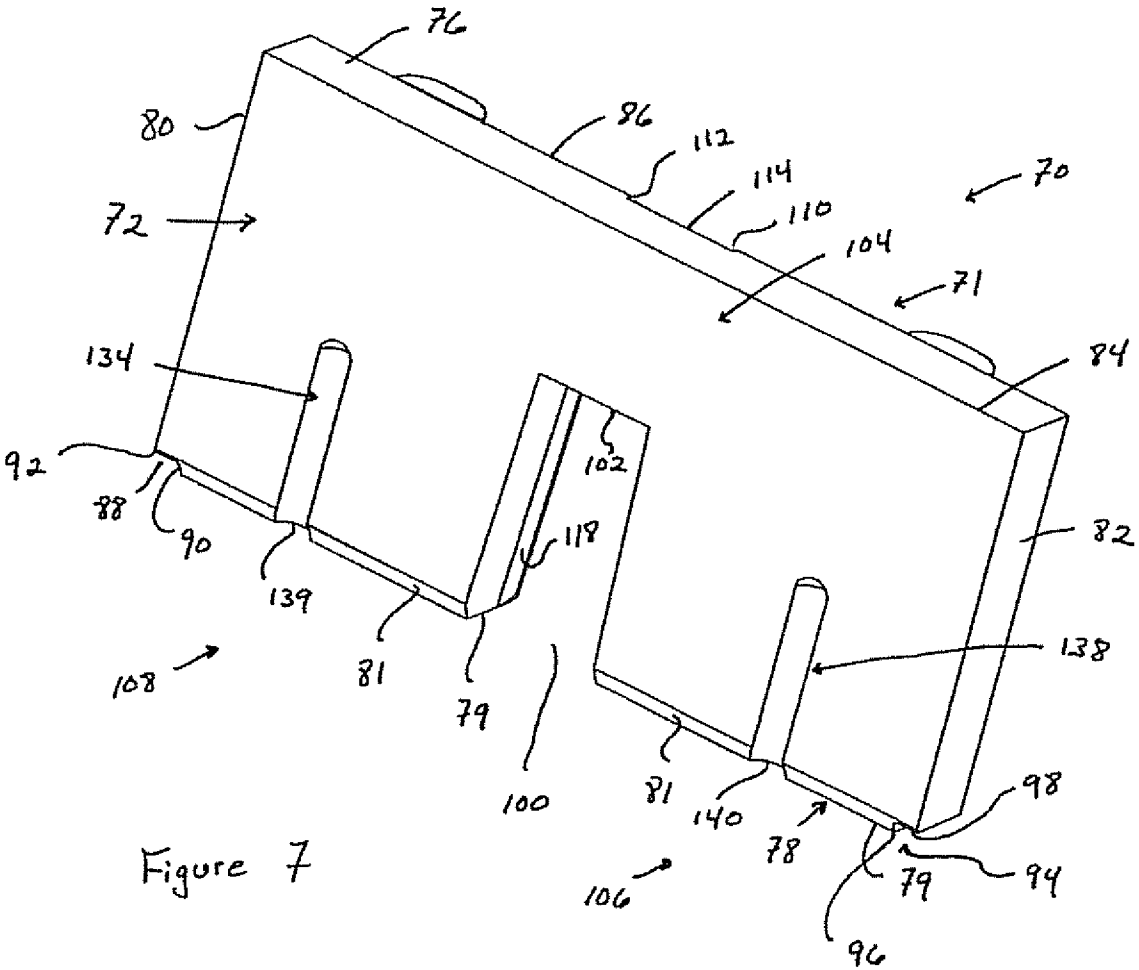
FIG. 7 is a schematic depicting an elevational view of a forward wall of the second insulation member depicted in FIG. 6.

Referring to FIGS. 6 and 7, second insulation member 70 comprises a body 71 having a forward wall 72 oppositely situated to a rearward wall 74, a top wall 76 oppositely situated to a bottom wall 78, and a lateral wall 80 oppositely situated to a lateral wall 82. Top wall 76 comprises an anterior leading edge 84 oppositely formed to a posterior leading edge 86. Anterior leading edge 84 is contiguously formed with lateral wall 80, lateral wall 82, and forward wall 72, while posterior leading edge 86 is contiguously formed with lateral wall 80, lateral wall 82, and rearward wall 74.

Bottom wall 78 comprises a planar portion 79 which is substantially parallel to top wall 76 and which is contiguously formed with rearward wall 74. Bottom wall 78 further comprises a sloped portion 81 which is contiguously formed with planar portion 79 and with forward wall 72, wherein sloped portion 81 slopes downwardly from forward wall 72 to planar portion 79.

Bottom wall 78 is offset from lateral wall 80 to form a channel 88 which extends from forward wall 72 to rearward wall 74, and which is defined, at least in part, by an upper abutment wall 92 which is transversely positioned to a lateral abutment wall 90. Similarly, bottom wall 78 is offset from lateral wall 82 to form a channel 94 which extends from forward wall 72 to rearward wall 74, and which is defined, at least in part, by an upper abutment wall 98 which is transversely positioned to a lateral abutment wall 96.

An opening 100 is centrally formed through bottom wall 78 and through forward wall 72 and rearward wall 74 and extends towards top wall 76 where it terminates at an underside 102 of an abutment portion 104 of body 71, wherein abutment portion 104 is located approximately above a horizontal mid-section X of body 71. Opening 100 confers a substantially U-shaped configuration to body 71, and essentially divides second insulation member 70 into a portion 106 and a portion 108, wherein abutment portion 104 is contiguously formed with and joins portion 106 to portion 108.

Referring to FIG. 6, rearward wall 74 of abutment portion 104 is recessed relative to rearward walls 74 of portion 106 and portion 108, thereby creating a lateral wall 110 and a lateral wall 112, wherein lateral wall 110 is contiguously formed with rearward wall 74 of portion 106, lateral wall 112 is contiguously formed with rearward wall 74 of portion 108, and each of lateral walls 110 and 112 is parallel to lateral walls 80 and 82. Where lateral wall 110 meets posterior leading edge 86 of top wall 76, posterior leading edge 86 turns perpendicularly towards anterior leading edge 84, then turns perpendicularly towards lateral wall 112, and then turns perpendicularly towards rearward wall 74 to join to lateral wall 112 to effectively form a notched portion 114 on an area of top wall 76, wherein notched portion 114 has underside 102 as its lowermost boundary.

Second insulation member 70 further comprises flanges 116 and 118. Flanges 116 and 118 respectively extend from rearward wall 74 and from planar portion 79 of bottom wall 78 of portions 106 and 108 towards and into opening 100 where they respectively terminate at top walls 120 and 122.

Referring to FIG. 7, forward wall 72 comprises a relatively planar surface. A vertically-directed, concave-shaped proximal groove 134 is formed within forward wall 72 at portion 108 and extends into sloped portion 81 of bottom wall 78 to form an essentially concave-shaped groove 139 within sloped portion 81. A vertically-directed, concave-shaped distal groove 138 is formed within forward wall 72 at portion 106 and extends into sloped portion 81 of bottom wall 78 to form an essentially concave-shaped groove 140 within sloped portion 81.

Referring to FIGS. 1-3, first insulation member 12 is attached to second insulation member 70 by engaging plug 54 within grooves 138 and 140 and by engaging plug 54' within grooves 134 and 139 such that openings 26 and 100 are aligned. Once so engaged, first insulation member 12 is offset relative to second insulation member 70 such that lateral wall 20 of first insulation member 12 extends past lateral wall 82 of second insulation member 70, lateral wall 80 of second insulation member 70 extends past lateral wall 18 of first insulation member 12, and planar portion 38 of top side 22 extends past top wall 76.

Figure 8:
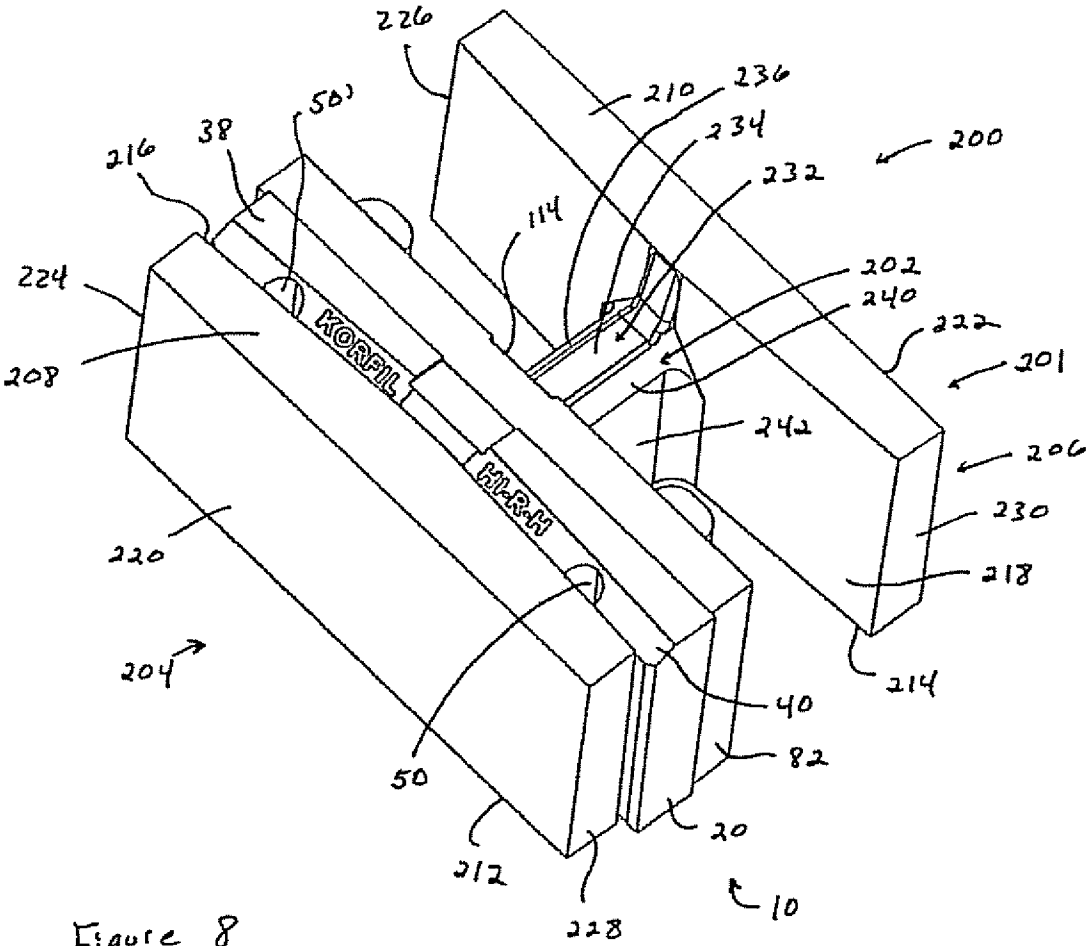
FIGS. 8-10 are schematics depicting an exemplary masonry unit comprising the insulation insert depicted in FIGS. 1-3.
Figure 9:
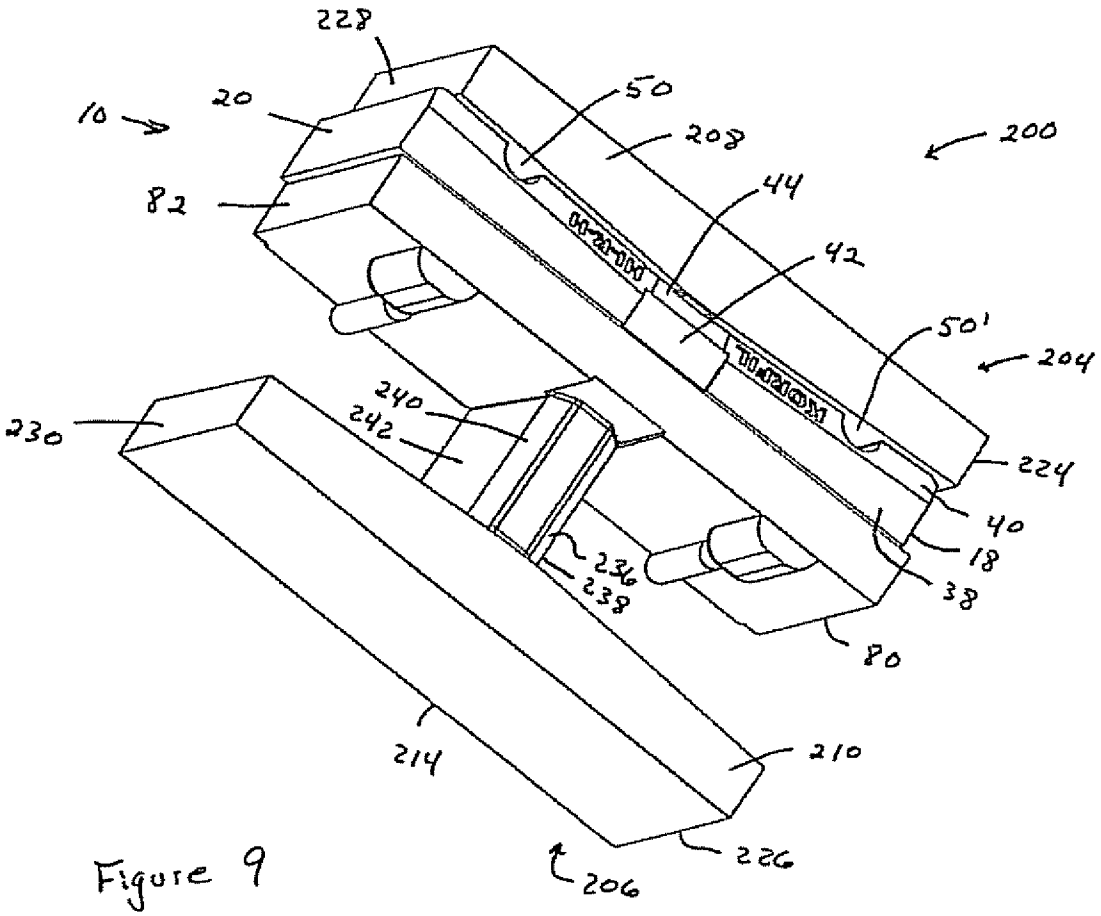
Figure 10:
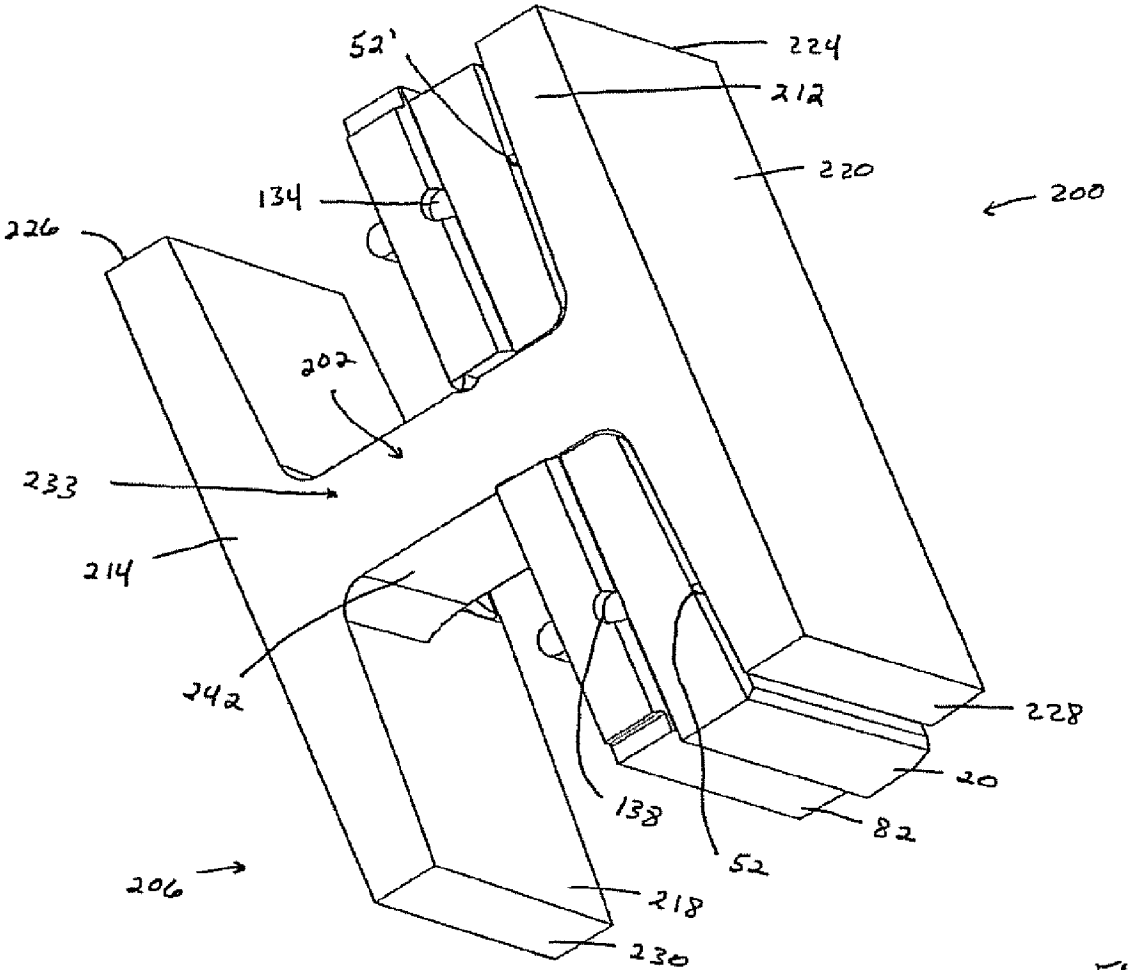

Insulation insert 10 may be positioned within an exemplary block 201 as shown in FIGS. 8-10 to form an exemplary masonry unit 200. Here, block 201 comprises a web 202 centrally disposed between and connected to an anterior face shell 204 and an oppositely situated posterior face shell 206.

Each of face shells 204 and 206 comprises a respective top side 208 and 210 oppositely situated to a respective bottom side 212 and 214, a respective interior-directed side 216 and 218 oppositely directed to a respective exterior-directed side 220 and 222, and a respective lateral side 224 and 226 oppositely directed to a respective lateral side 228 and 230. Top side 208 tapers downwardly towards and is contiguous with exterior-directed side 220 of anterior face shell 204 such that a vertical height of anterior face shell 204 is lower at exterior-directed side 220 by about ⅛ of an inch compared to a vertical height of interior-directed side 216. Such a difference in height protects insulation insert 10 from being compressed by the weight of a masonry unit(s) that lie(s) above masonry unit 200 during cubing, prevents water from flowing into the mortar joint as the water flows down anterior face shell 204, and allows compaction of mortar at interior-directed side 216 when a mortar joint is tooled as less space is created at interior-directed side 216.

Web 202 comprises a top side 232 directed towards top sides 208 and 210 and oppositely situated to a bottom side 233. Top side 232 comprises a horizontal length that extends from interior-directed sides 216 and 218 of respective face shells 204 and 206. Top side 232 further comprises a recessed portion 234 that extends along the horizontal length of top side 232. Recessed portion 234 is flanked on a side thereof by a sloped lateral wall 236 which slopes away from recessed portion 234 downwardly towards an abutment side wall 238, and is flanked on an opposite thereof by a sloped lateral wall 240 which slopes away from recessed portion 234 downwardly towards an abutment side wall 242. Abutment side walls 238 and 242 are contiguously formed with bottom side 233. Furthermore, each of abutment side walls 238 and 242 comprises a respective groove (not shown) formed therein, wherein the groove is transversely formed relative to bottom side 233.

When insulation insert 10 is assembled on block 201, flange 116 engages with the groove formed in abutment side wall 238 and flange 118 engages with the groove formed in abutment side wall 242 to thereby secure insulation insert 10 in a vertical position and to thereby prevent insulation insert 10 from slipping out of position. Underside 25 of abutment wall 28 and underside 102 of abutment portion 104 abut top side 232 of web 202 and are guided thereon by sloped lateral walls 236 and 240. Top side 208 extends above top side 22 and top wall 76, and sloped portion 40 of top side 22 of first insulation member 12 abuts interior-directed side 216 of anterior face shell 204. Additionally, lateral walls 20 and 82 of insulation insert 10 extend past lateral side 228 of anterior face shell 204, and lateral side 224 of anterior face shell 204 extends past lateral walls 18 and 80 of insulation insert 10.

Figure 11:
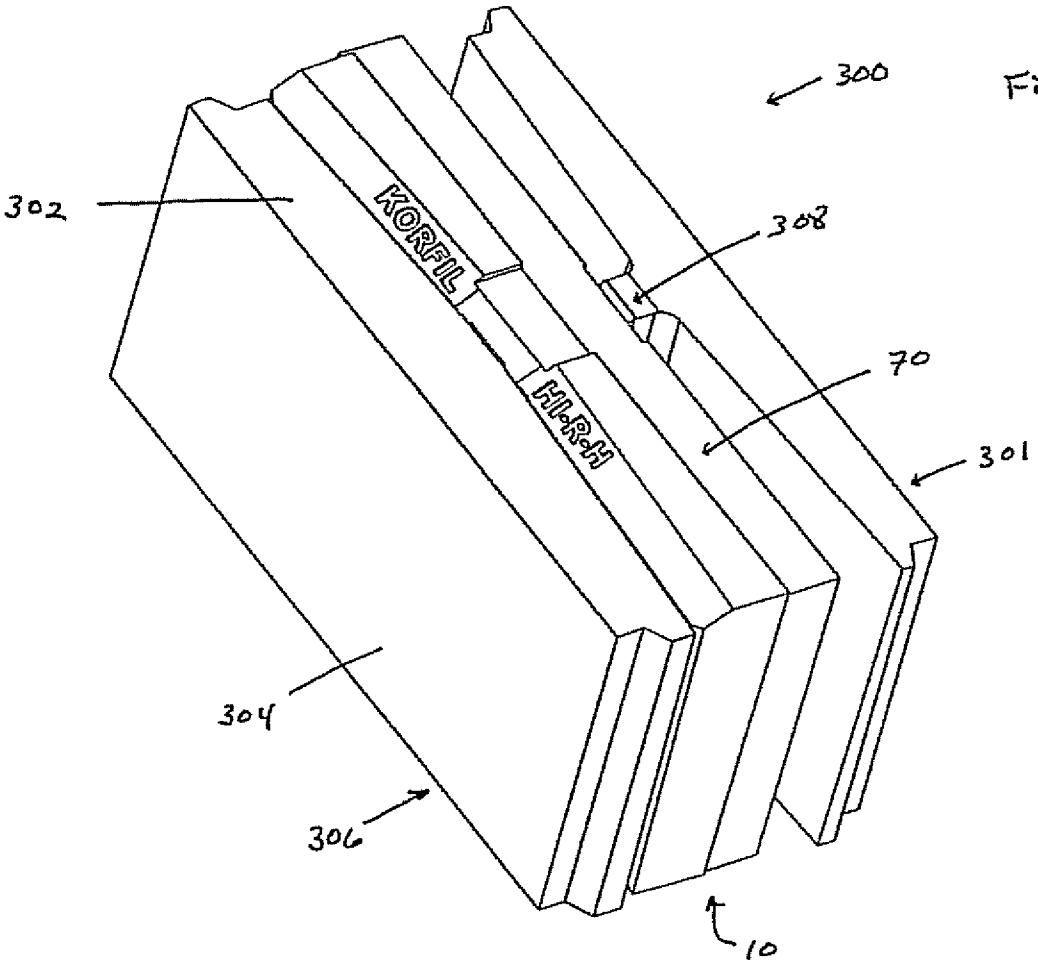
FIG. 11 is a schematic depicting another exemplary masonry unit comprising the insulation insert depicted in FIGS. 1-3.
Figure 12:
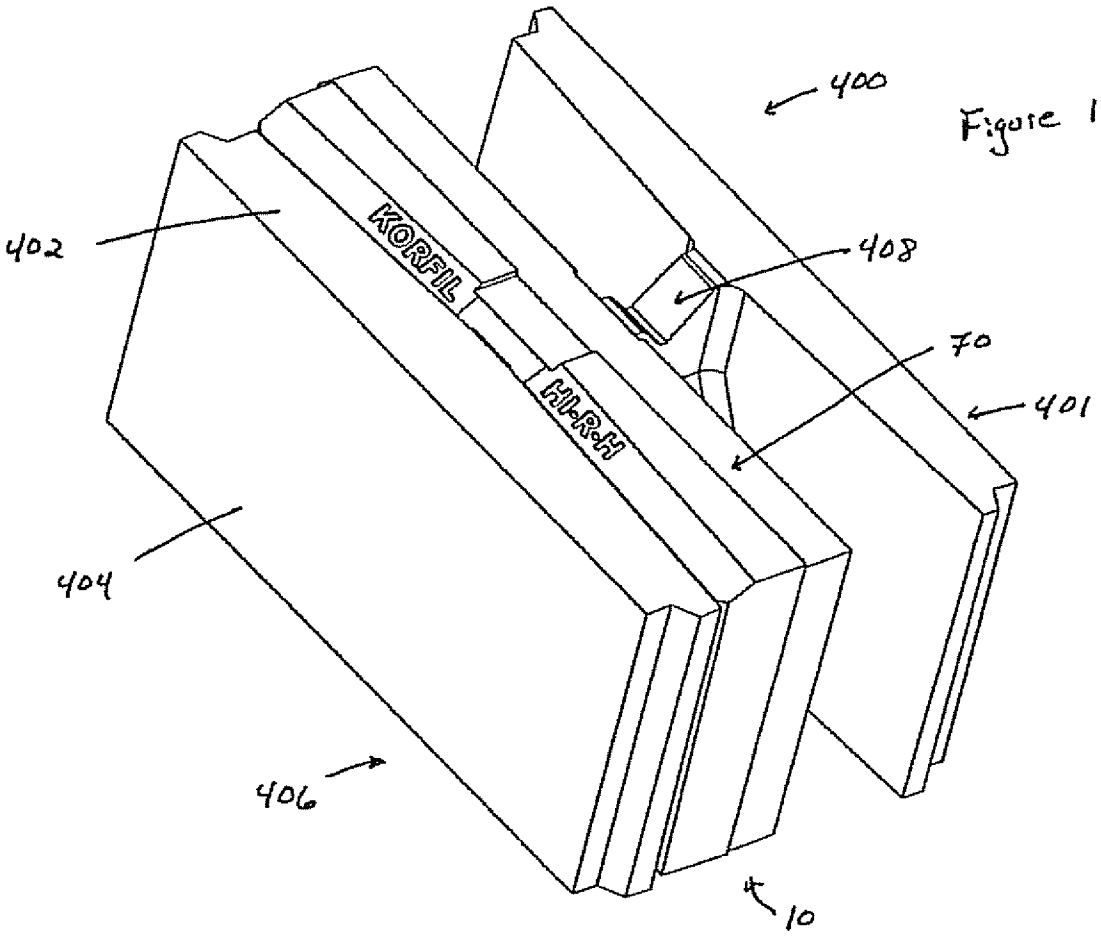
FIG. 12 is a schematic depicting another exemplary masonry unit comprising the insulation insert depicted in FIGS. 1-3.
Figure 13:
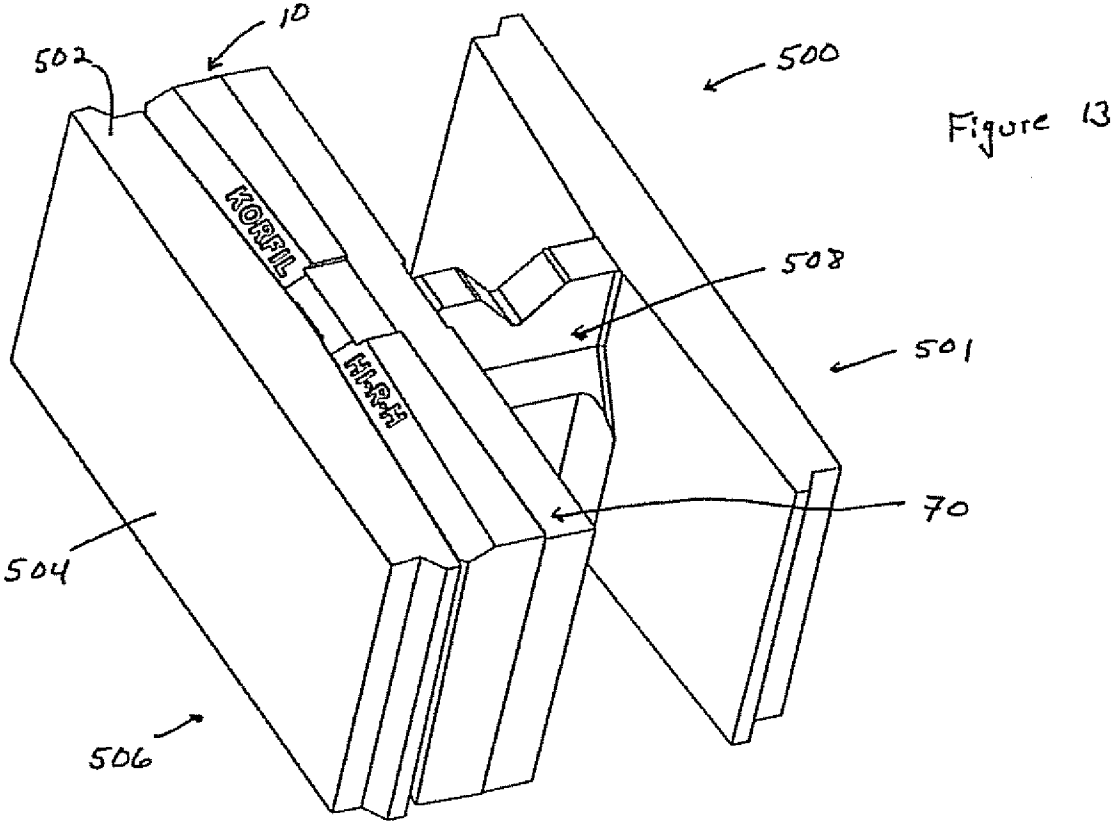
FIG. 13 is a schematic depicting another exemplary masonry unit comprising the insulation insert depicted in FIGS. 1-3.

FIGS. 11-13 respectively depict other exemplary masonry units 300, 400, and 500. Each of masonry units 300, 400, and 500 comprises insulation insert 10 in association with respective blocks 301, 401, and 501. Similar to block 201, blocks 301, 401, and 501 respectively comprises tapered top sides 302, 402, and 502, which slope downwardly towards and are coterminous with respective exterior-directed sides 304, 404, and 504 of respective anterior face shells 306, 406, and 506. Blocks 301, 401, and 501, further respectively comprise a web 308, 408, and 508 having respective proximal abutment side walls and oppositely situated distal abutment side walls. Each of proximal and distal abutment side walls 310, 410, 510, 312, 412, and 512 has a groove formed therein, wherein the grooves receive flanges 116 and 118 of second insulation member 70.

Figure 14:
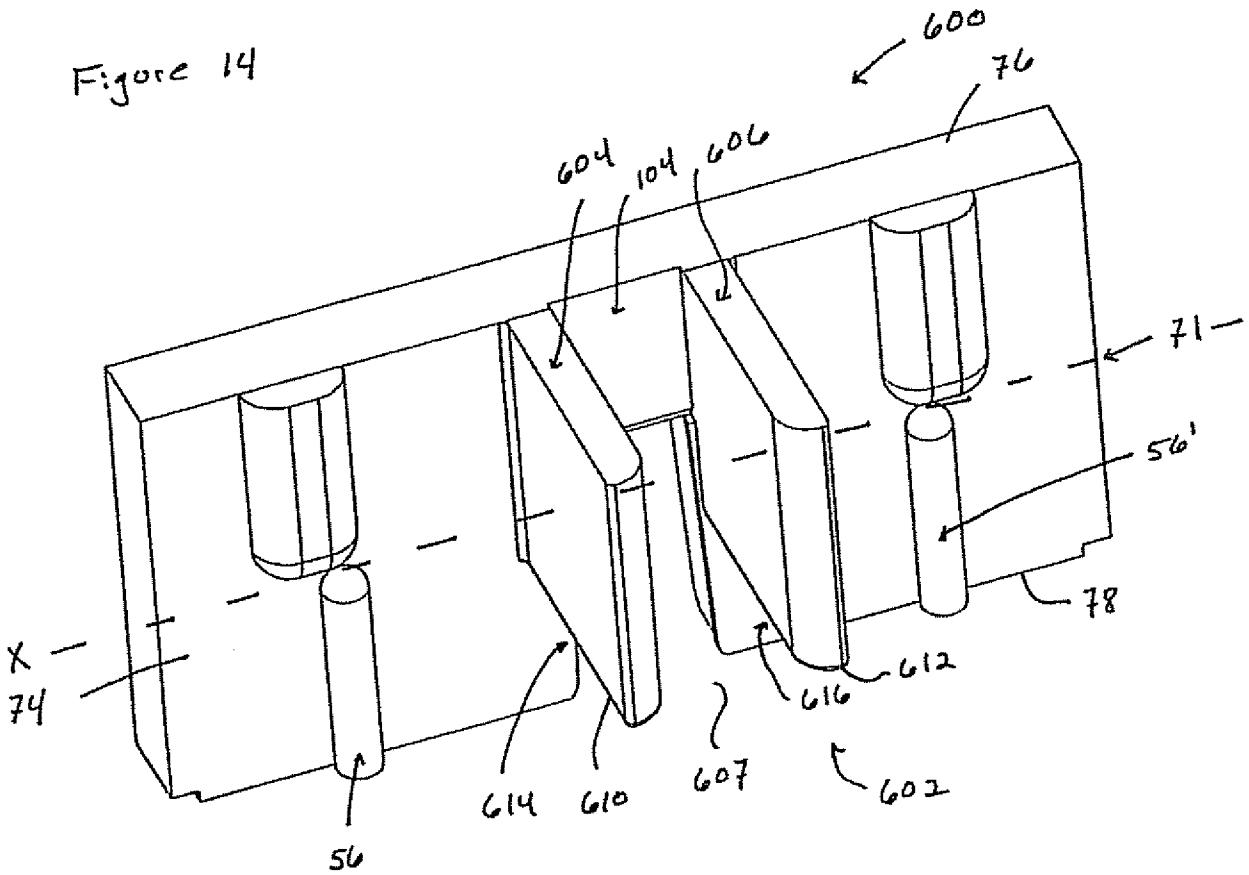
FIGS. 14 and 15 are schematics depicting another exemplary second insulation member.
Figure 15:
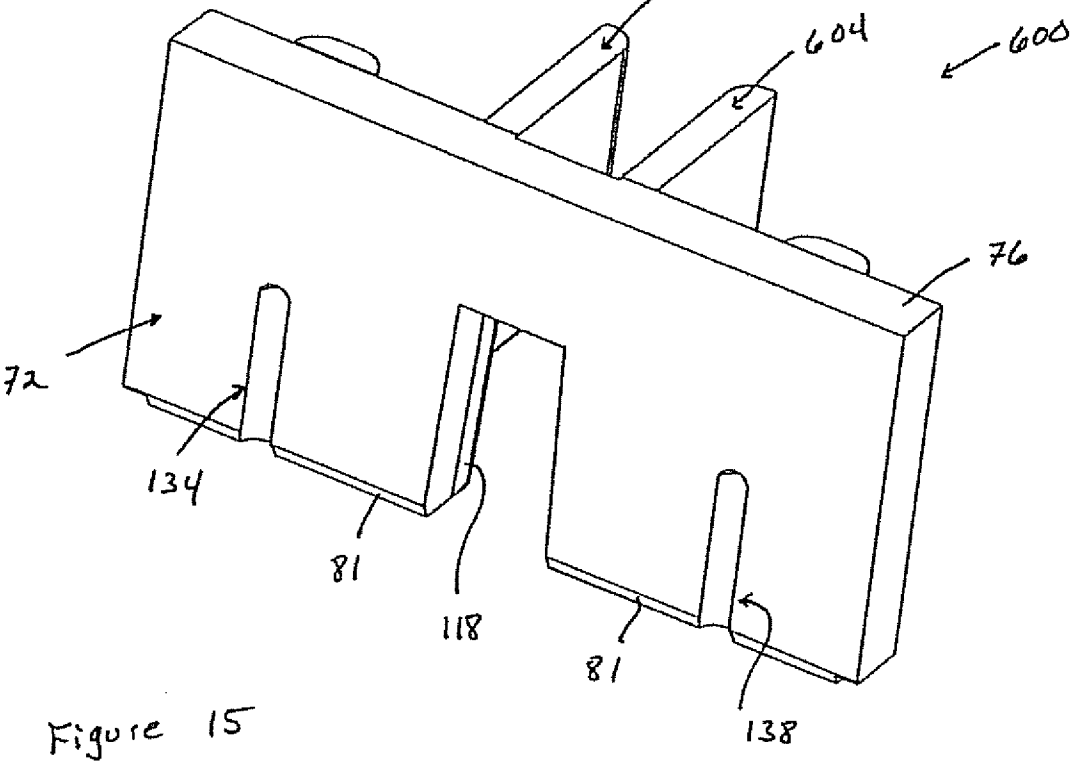

FIGS. 14 and 15 depict an exemplary second insulation member 600. Second insulation member 600 is essentially identical to second insulation member 70 except that second insulation member 600 further comprises a grout shut-off saddle 602 positioned on rearward wall 74 thereof. Saddle 602 comprises a plate 604 and a plate 606 which is disposed on rearward wall 74 and extends outwardly therefrom on opposite sides of abutment portion 104 such that plates 604 and 606 are transversely positioned relative to rearward wall 74 and are parallel to one another to thereby form an opening 607 between plates 604 and 606. Each of plates 604 and 606 extends below horizontal axis X which defines a midline of body 71 of second insulation member 600 and creates a respective space 614 and 616 between a respective bottom side 610 and 612 of plates 604 and 606 and between bottom wall 78 of body 71.

Figure 16:
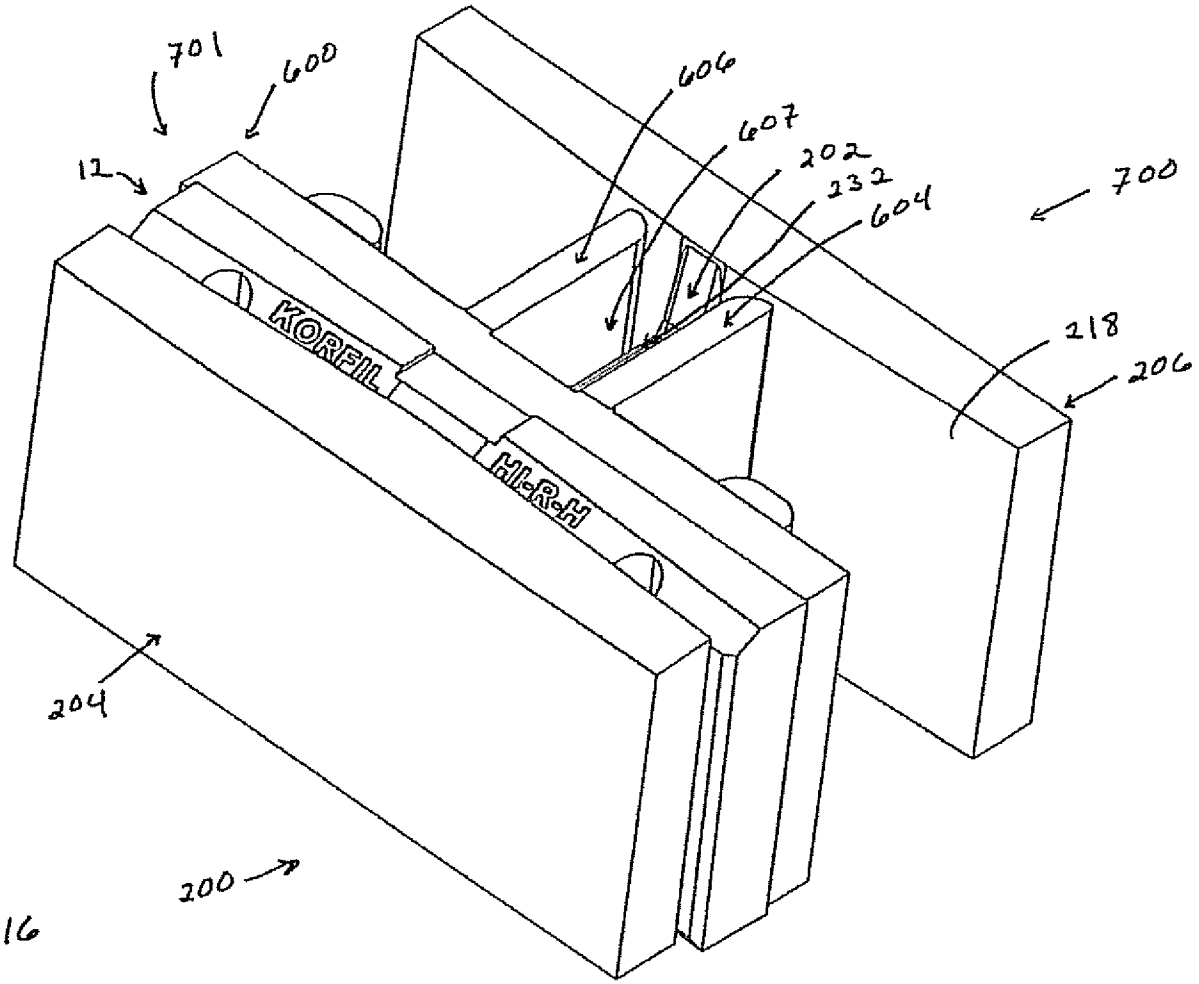
FIGS. 16 and 17 are schematics depicting an exemplary masonry unit comprising the second insulation member depicted in FIGS. 14 and 15 in combination with the first insulation member depicted in FIGS. 4 and 5.
Figure 17:
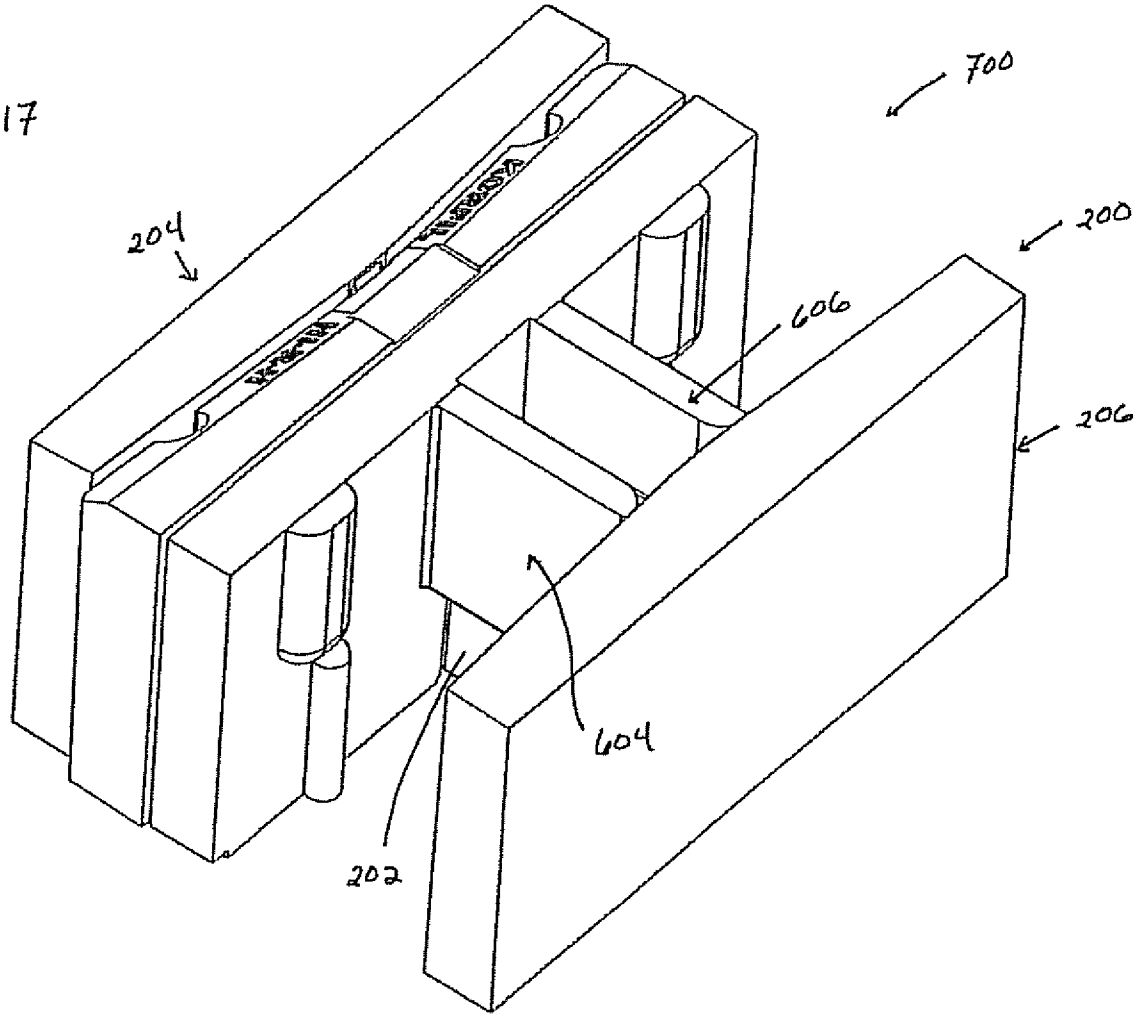

Referring to FIGS. 16 and 17, a masonry unit 700 comprises an insulation insert 701 engaged with block 200. Insulation insert 701 comprises second insulation member 600 and first insulation member 12. As shown in FIGS. 16 and 17, web 202 fits within opening 607, and plates 604 and 606 of saddle 602 extend over top side 232 of web 202 and further extend to and physically abut interior-directed side 218 of posterior face shell 206. In this arrangement, liquid grout is prevented from flowing into adjacent block cores.

It is noted that, in another exemplary embodiment, saddle 602 may be replaced by a separately molded U-shaped insert that may be placed over the top of the web on those cores where no grout is required.

Figure 18:
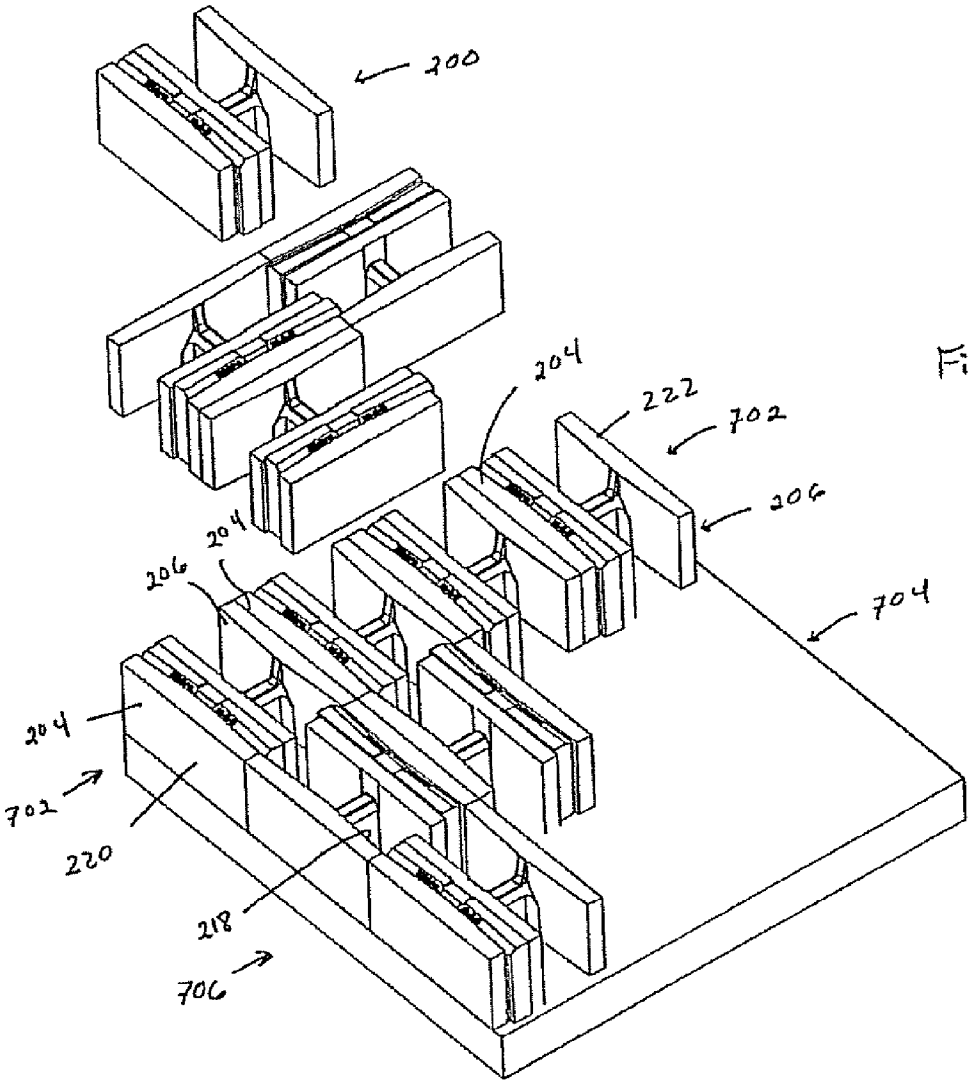
FIGS. 18-20 are schematics depicting an exemplary method of cubing the masonry units depicted in FIGS. 8-10.
Figure 19:
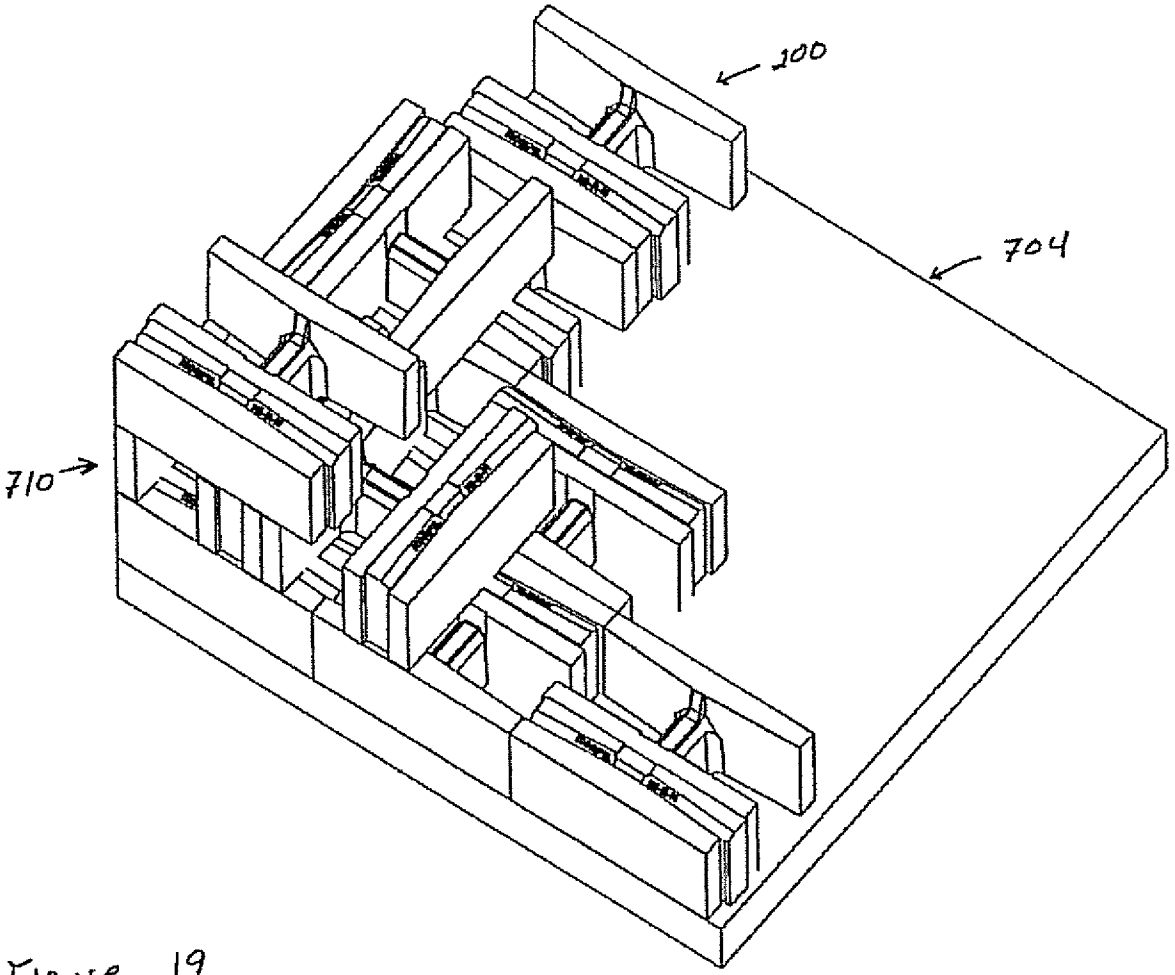
Figure 20:
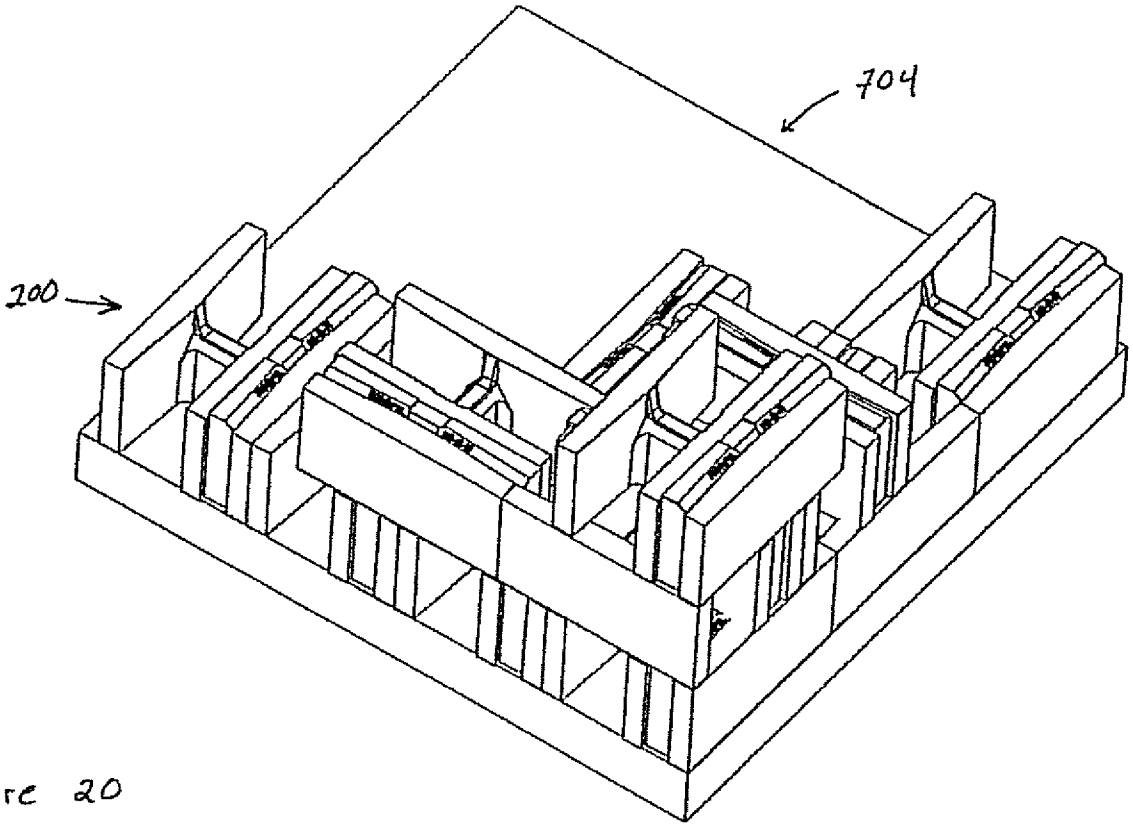

FIGS. 18-20 show an exemplary method of cubing a plurality of masonry units 200. Referring to FIG. 18, an exemplary method comprises providing a first layer of masonry units 200 on a foundation 704. Here, a row 702 comprising a plurality of masonry units 200 is positioned on foundation 704 such that adjacent masonry units 200 are positioned back to back to one another, e.g., exterior-directed side 222 of posterior face shell 206 of one of masonry units 200 from row 702 physically abuts exterior-directed side 220 of anterior face shell 204 of an immediately adjacent masonry unit 200 from row 702.

A row 706 comprising a plurality of masonry units 200 is placed immediately adjacent to row 702 such that masonry units 200 of row 706 are oppositely situated to masonry units 200 of row 702, and further such that forward walls 14 of first insulation members 12 of masonry units 200 of row 702 physically abut immediately adjacent interior-directed sides 218 of posterior face shells 206 of masonry units 200 of row 706 and vice versa. Each subsequent row comprising a plurality of masonry units 200 may be laid in this alternating fashion.

Referring to FIGS. 19 and 20, masonry units 200 may be stacked on top of the first layer of masonry units 200 by transversely positioning a second layer 710 of masonry units directly on and over the immediately underlying first layer. Similar to the positioning of the masonry units of the first layer, the masonry units of second layer 710 are positioned such that masonry units 200 forming a first row of second layer 710 are aligned, e.g., front to back; and masonry units 200 of a second row from second layer are aligned, e.g., back to front. Subsequent layers may be stacked in a manner as shown in FIGS. 19 and 20.

As would be obvious from a reading of the above-disclosure in light of the figures and claims included herein, the masonry unit described above has several advantages over the prior art. For example, the newly designed plug and groove feature provided on the respective first and second insulation members allows the insulation insert to be removed easily from a broken block, and further allows the first and second insulation members to be engaged with one another for use in another block.

The slope added to the top side of the first insulation member, along with the weep hole provided at the bottom of the thumb grips, provide a drainage path for water to drain out of the weeps located at the bottom side of the first insulation insert member. Additionally, the slope provided at the bottom side of the first insulation member provides a path for water to flow away from the masonry unit.

The thumb grips provided in the forward wall of the first insulation member allow the mason to grip the face shells of the block more readily.

Additionally, placement of the insulation insert onto the block and the hold of the insulation insert once positioned on the block have been enhanced. The depression formed on the top side of the web of the block assists in guiding the insulation insert into a vertical position. Additionally, by providing the second insulation member with a first and second flange, and by providing the web with a first and second groove respectively formed on opposite abutment side walls of the web, wherein the first flange is received within the first groove and the second flange is received within the second groove, the insulation insert is vertically held in place on the block.

Furthermore, the use of plates on the second insulation member which flank the abutment side walls of the web of the block prevents liquid grout from flowing into adjacent block cores.

A slope has been formed at the top side of the anterior face shell of the block so that a vertical height of the exterior-directed side of the anterior face shell is lower than a vertical height of the interior-directed side of the anterior face shell. Such slope protects the insulation insert from being compressed by the weight of the masonry units located above the insulation insert during cubing. The slope also prevents water from working its way into the mortar joint as the water runs down the anterior face wall. The slope also prevents compaction of mortar at the interior-directed side of the anterior face wall compared to the exterior-directed side of the anterior face wall when the mortar joint is tooled.

A method of cubing the masonry blocks is further provided, wherein such method is used in lieu of extending the length of the block, thereby, protecting the insulation inserts from breakage.

The foregoing description of the preferred embodiment of the invention is to be considered as illustrative and not as limiting. Various other changes and modifications will occur to those skilled in the art for performing substantially the same function, in substantially the same way, to achieve substantially the same result without departing from the true scope of the invention as defined in the appended claims.

What is claimed is:

1. A masonry unit, comprising:

an insulation insert, comprising:

a first insulation member, comprising:

a proximal lateral wall oppositely situated to a distal lateral wall;

a forward wall oppositely situated to a rearward wall;

a top side oppositely situated to a bottom side, wherein the top side has a sloped portion which slopes downwardly towards the forward wall and which is contiguously formed with the proximal lateral wall, the distal lateral wall, and the forward wall; and an opening centrally formed through the bottom side, the forward wall, and the rearward wall of the first insulation member to thereby give the first insulation member a generally U-shaped configuration, and dividing the first insulation member vertically into a first portion and a second portion, wherein each of the first and second portions of the first insulation member comprises:

a thumb grip formed on the forward wall and extending into the sloped portion of the top side on one side thereof, and having a weep hole formed on an opposite side thereof;

a channel formed on the forward wall, wherein the channel extends from the weep hole to the bottom side; and an engagement member formed on the rearward wall; and a second insulation member, comprising:

a proximal lateral wall oppositely situated to a distal lateral wall;

a forward wall oppositely situated to a rearward wall;

a top side oppositely situated to a bottom side; and an opening centrally formed through the bottom side, the forward wall, and the rearward wall of the second insulation member to thereby give the second insulation member a generally U-shaped configuration, and dividing the second insulation member vertically into a first portion and a second portion, wherein each of the first and second portions of the second insulation member comprises an engagement member formed on the forward wall of the second insulation member;

wherein the engagement member of the first portion of the first insulation member is engaged with the engagement member of the first portion of the second insulation member, and the engagement member of the second portion of the first insulation member is engaged with the engagement member of the second portion of the second insulation member, and further wherein the opening of the first insulation member is aligned with the opening of the second insulation member.

2. The masonry unit of claim 1, wherein each of the engagement members of the first insulation member comprises a plug formed on the rearward wall of the first insulation member, and each of the engagement members of the second insulation member comprises a groove formed through the forward wall of the second insulation member, wherein the plug of the first portion of the first insulation member is engaged with the groove of the first portion of the second insulation member, and the plug of the second portion of the first insulation member is engaged with the groove of the second portion of the second insulation member.

3. The masonry unit of claim 1, wherein the proximal lateral wall of the first insulation member is directed towards the proximal lateral wall of the second insulation member, and the distal lateral wall of the first insulation member is directed towards the distal lateral wall of the second insulation member, and further wherein the proximal lateral wall of the first insulation member overlaps the proximal lateral wall of the second insulation member and the distal lateral wall of the second insulation member overlaps the distal lateral wall of the first insulation member.

4. The masonry unit of claim 1, wherein the top side of the first insulation member further comprises a substantially planar portion contiguously formed with the rearward wall, the proximal lateral wall, the distal lateral wall, and the sloped portion of the first insulation member, and further wherein the substantially planar portion has a recessed notch centrally formed therein, wherein the recessed notch is aligned with the opening of the first insulation member.

5. The masonry unit of claim 4, wherein the sloped portion of the top side of the first insulation member comprises a recessed notch centrally formed therein, wherein the recessed notch of the sloped portion is aligned with the opening of the first insulation member, and further wherein the recessed notch of the sloped portion is overlapped by the recessed notch of the substantially planar portion.

6. The masonry unit of claim 1, further comprising a block, wherein the block comprises a web transversely formed and centrally connected to an anterior face shell and a posterior face shell, wherein the anterior face shell is oppositely situated to the posterior face shell, and wherein the web is received within the openings of the first and second insulation members.

7. The masonry unit of claim 6, wherein the anterior face shell has a top side oppositely situated to a bottom side, a proximal lateral side oppositely situated to a distal lateral side, and an exterior directed side oppositely situated to an anterior directed side, wherein the forward wall of the first insulation member physically abuts the interior directed side of the anterior face shell, and further wherein the top side of the anterior face shell slopes downwardly towards the exterior directed side.

8. The masonry unit of claim 7, wherein the proximal lateral wall of the first insulation member is directed towards the proximal lateral walls of the second insulation member and the anterior face shell, and the distal lateral wall of the first insulation member is directed towards the distal lateral walls of the second insulation member and the anterior face shell, and further wherein the proximal lateral wall of the first insulation member overlaps the proximal lateral walls of the second insulation member and the anterior face shell, and the distal lateral wall of the first insulation member is overlapped by the distal lateral walls of the second insulation member and the anterior face shell.

9. The masonry unit of claim 6, wherein:

the web comprises a top side oppositely situated to a bottom side, and a proximal abutment side wall oppositely situated to a distal abutment side wall, wherein each of the proximal and distal abutment side walls has a groove formed therein; and each of the first and second portions of the second insulation member comprises a flange that extends from the rearward wall into the opening of the second insulation member;

wherein the flange of the first portion of the second insulation member is received within the groove of the proximal abutment side wall and the flange of the second portion of the second insulation member is received within the groove of the distal abutment side wall.

10. The masonry unit of claim 9, wherein each of the first and second abutment side walls comprises a sloped portion contiguously formed with the top side of the web, wherein each of the sloped portions slope downwardly from the top side of the web towards the bottom side of the web.

11. A masonry unit, comprising:

an insulation insert, comprising:

a first insulation member having a forward wall oppositely situated to a rearward wall, a top side oppositely situated to a bottom side, and an opening centrally formed through the forward wall, the rearward wall, and the bottom side, wherein the opening terminates at an abutment wall directed opposite to the bottom side, and further wherein the opening vertically divides the first insulation member into a first portion and a second portion, wherein each of the first and second portions comprises:

a thumb grip formed on the forward wall and the top side;

an engagement member formed on the rearward wall; and a channel contiguously formed with the thumb grip, wherein the channel extends from the thumb grip to the bottom side of the first insulation member; and a second insulation member having a forward wall oppositely situated to a rearward wall, a top side oppositely situated to a bottom side, and an opening centrally formed through the forward wall, the rearward wall, and the bottom side, wherein the opening terminates at an abutment wall directed opposite to the bottom side, and further wherein the opening vertically divides the second insulation member into a first portion and a second portion, wherein each of the first and second portions comprises an engagement member that engages with the engagement member formed on the rearward wall of the first insulation member.

12. A masonry unit, comprising:

an insulation insert, comprising:

a first insulation member having a forward wall oppositely situated to a rearward wall, a top side oppositely situated to a bottom side, and an opening centrally formed through the forward wall, the rearward wall, and the bottom side, wherein the opening terminates at an abutment wall directed opposite to the bottom side, and further wherein the opening vertically divides the first insulation member into a first portion and a second portion, wherein each of the first and second portions comprises:

a thumb grip formed on the forward wall and the top side; and an engagement member formed on the rearward wall; and a second insulation member having a forward wall oppositely situated to a rearward wall, a top side oppositely situated to a bottom side, and an opening centrally formed through the forward wall, the rearward wall, and the bottom side, wherein the opening terminates at an abutment wall directed opposite to the bottom side, and further wherein the opening vertically divides the second insulation member into a first portion and a second portion, wherein each of the first and second portions comprises an engagement member that engages with the engagement member formed on the rearward wall of the first insulation member; and a block wherein the block comprises a web transversely formed and centrally connected to an anterior face shell and a posterior face shell, wherein the anterior face shell is oppositely situated to the posterior face shell, wherein the web is received within the openings of the first and second insulation members, and further wherein the web comprises a proximal abutment side wall oppositely situated to a distal abutment side wall, wherein each of the proximal and distal abutment side walls has a groove formed therein, and further wherein each of the first and second portions of the second insulation member comprises a flange that extends from the rearward wall of the second insulation member into the opening of the second insulation member, wherein the flanges are respectively received within one of the grooves formed on the proximal and distal abutment side walls of the block.

* * * * *